US007674011B2

(12) United States Patent
Zhou et al.

(10) Patent No.: US 7,674,011 B2
(45) Date of Patent: Mar. 9, 2010

(54) LED LAMP HAVING A VAPOR CHAMBER FOR DISSIPATING HEAT GENERATED BY LEDS OF THE LED LAMP

(75) Inventors: Zhi-Yong Zhou, Shenzhen (CN); Qiao-Li Ding, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 77 days.

(21) Appl. No.: 12/134,162

(22) Filed: Jun. 5, 2008

(65) Prior Publication Data

US 2009/0267474 A1 Oct. 29, 2009

(30) Foreign Application Priority Data

Apr. 23, 2008 (CN) ..... 2008 1 0066779

(51) Int. Cl.
*F21S 4/00* (2006.01)
*F21V 21/00* (2006.01)

(52) U.S. Cl. ..... 362/249.02; 362/294; 362/373; 362/545; 362/547; 362/800

(58) Field of Classification Search ..... 362/158, 362/249.02, 294, 373, 545, 547, 800
See application file for complete search history.

(56) References Cited

U.S. PATENT DOCUMENTS 6,789,921 B1 * 9/2004 Deloy et al. ..... 362/97.3
7,513,659 B2 * 4/2009 Vukosic et al. ..... 362/373

* cited by examiner

*Primary Examiner*—Jason Moon Han
(74) *Attorney, Agent, or Firm*—Frank R. Niranjan

(57) ABSTRACT

An LED lamp includes a heat dissipation device and a plurality of LED modules. The heat dissipation device includes a heat conductive member and a fin unit. The LED modules are attached to a top surface of a first plate of the heat conductive member. The heat conductive member comprises a plurality of posts embedded in the top surface of the first plate. Peripheries of the first and second plates are in a hermetical conjunction with each other to form a chamber containing phase-changeable working fluid therein. The first plate has a plurality of receiving recessions which are depressed downwardly from the top surface thereof and respectively receive the posts. Screws are used to extend through the LED modules to threadedly engage in the posts thereby to intimately mount the LED modules on the top surface of the first plate of the heat conductive member.

11 Claims, 4 Drawing Sheets

LED LAMP HAVING A VAPOR CHAMBER FOR DISSIPATING HEAT GENERATED BY LEDS OF THE LED LAMP

BACKGROUND OF THE INVENTION

1. Field of the Invention

The present invention relates to an LED lamp, and particularly to an LED lamp having a vapor chamber functioning as a heat dissipation device for removing heat from LEDs of the LED lamp.

2. Description of Related Art

The high power LED light devices produce considerable amount of heat, which may cause performance degrade or even damage if the heat is not removed from the LED chips efficiently. In an LED light device, the core is an LED chip mounted on a substrate. A transparent top covering the LED chip serves as a lens for modifying the direction of the emitted light. Although there are many different designs, the major heat dissipation route for the heat produced by the LED chip usually is managed through the base to which the LED chip is mounted or through an additional metal heat sink below the base and then to an outer heat sink.

Traditional adoption of the fans for active cooling system not only introduces noise problems but also brings risk of damage to a LED lamp if the fan is out of order. In contrast, passive cooling with natural convection is quite, continuous and time-unlimited. But since a natural convection system is relative weak for heat dissipation, to solve this problem, a large surface area is needed to enhance heat dissipation capacity. Most passive cooling devices for LED lamps simply use metallic blocks such as copper or aluminum blocks with extended fins for heat dissipation. However, the thermal dissipation capacities of these simple metal blocks with extended fins may be still insufficient for dissipating the heat generated from the LED lamps, which results in a relatively high temperature of the LED lamps during operation.

What is needed, therefore, is a heat dissipation device for an LED light device, which has an improved dissipating structure to thereby overcome the above mentioned disadvantages.

SUMMARY OF THE INVENTION

A heat dissipation device includes a heat conductive member, a fin unit coupled to a bottom surface of the heat conductive member and a plurality of LED modules attached to a top surface of the heat conductive member. The heat conductive member comprises a first plate, a second plate parallel to the first plate and a plurality of posts embedded in a top surface of the first plate. Peripheries of the first and second plates are in a hermetical conjunction with each other to form a chamber containing a phase-changeable working fluid in the heat conductive member. The first plate has a plurality of receiving recessions which are depressed downwardly from the top surface thereof and respectively receive the posts therein. A screw is used to extend through the LED module to threadedly engage in a screwed orifice of a corresponding post, thereby to tightly secure the LED module to the first plate of the heat conductive member. Accordingly, heat generated by the LED module can be effectively absorbed by the heat conductive member. The fin unit is thermally connected to the second plate of the heat conductive member.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
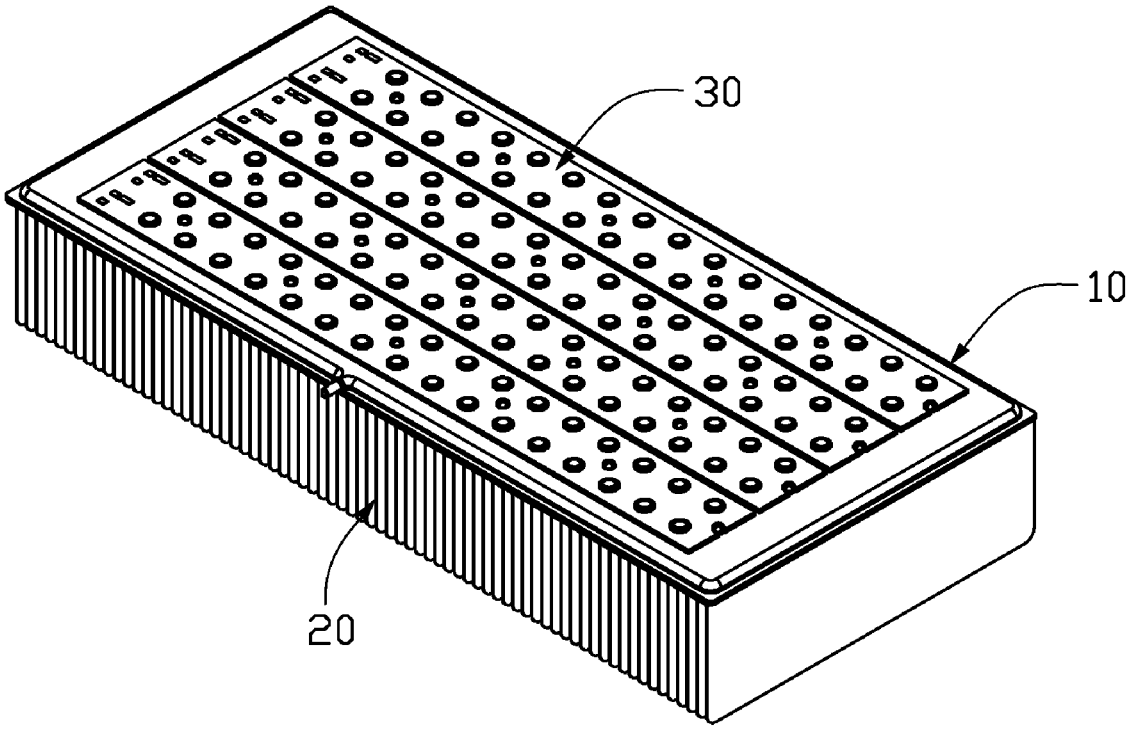
FIG. 1 is an isometric, assembled view of an LED lamp in accordance with a preferred embodiment of the present invention.
Figure 2:
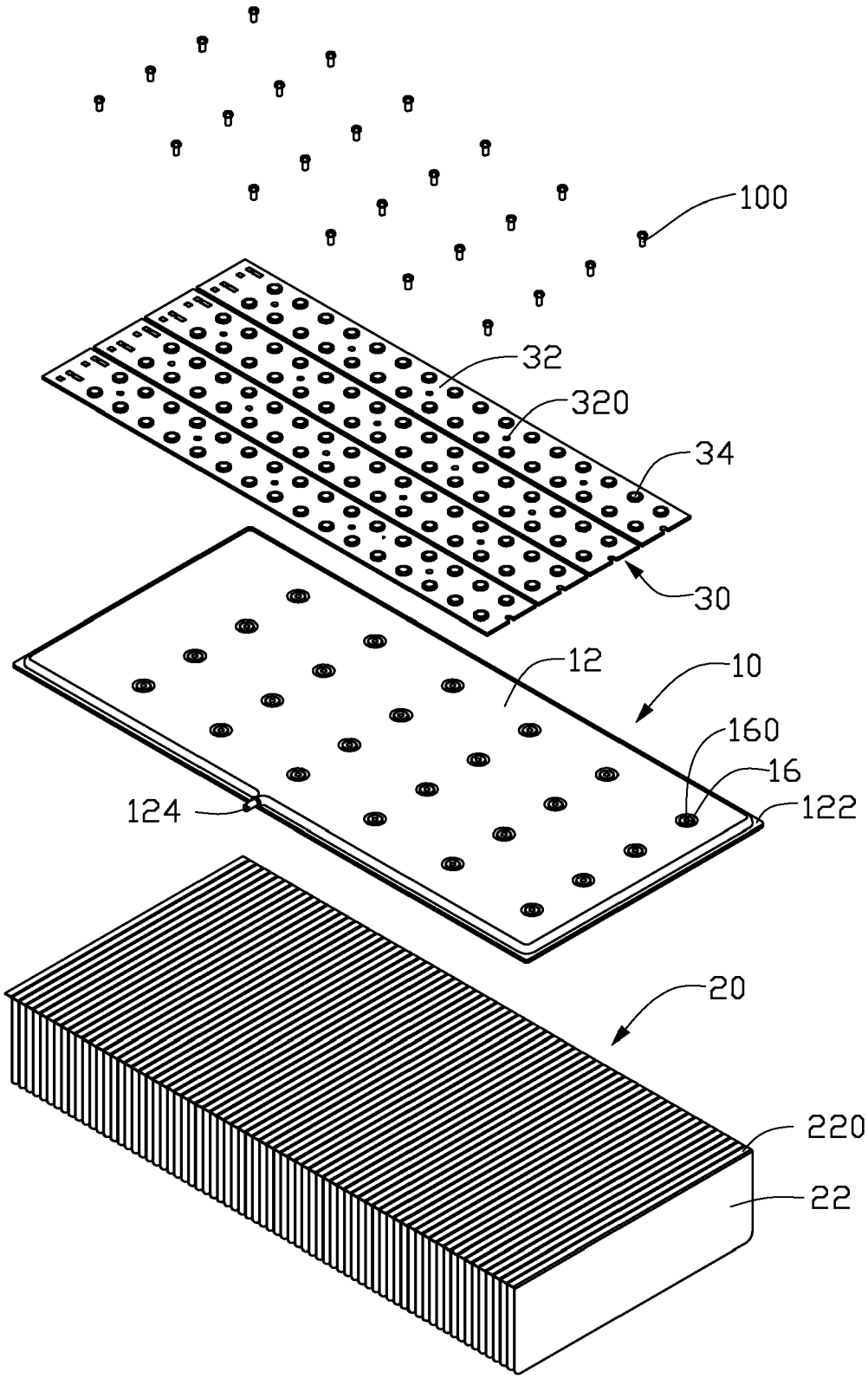
FIG. 2 is an exploded view of FIG. 1.

Referring to FIGS. 1-2, an LED lamp includes a heat dissipation device and a plurality of LED modules 30 mounted on the heat dissipation device. The heat dissipation device comprises a heat conductive member 10, a fin unit 20 coupled to a bottom surface of the heat conductive member 10 and a plurality of LED modules 30 attached to a top surface of the heat conductive member 10.

Figure 3:
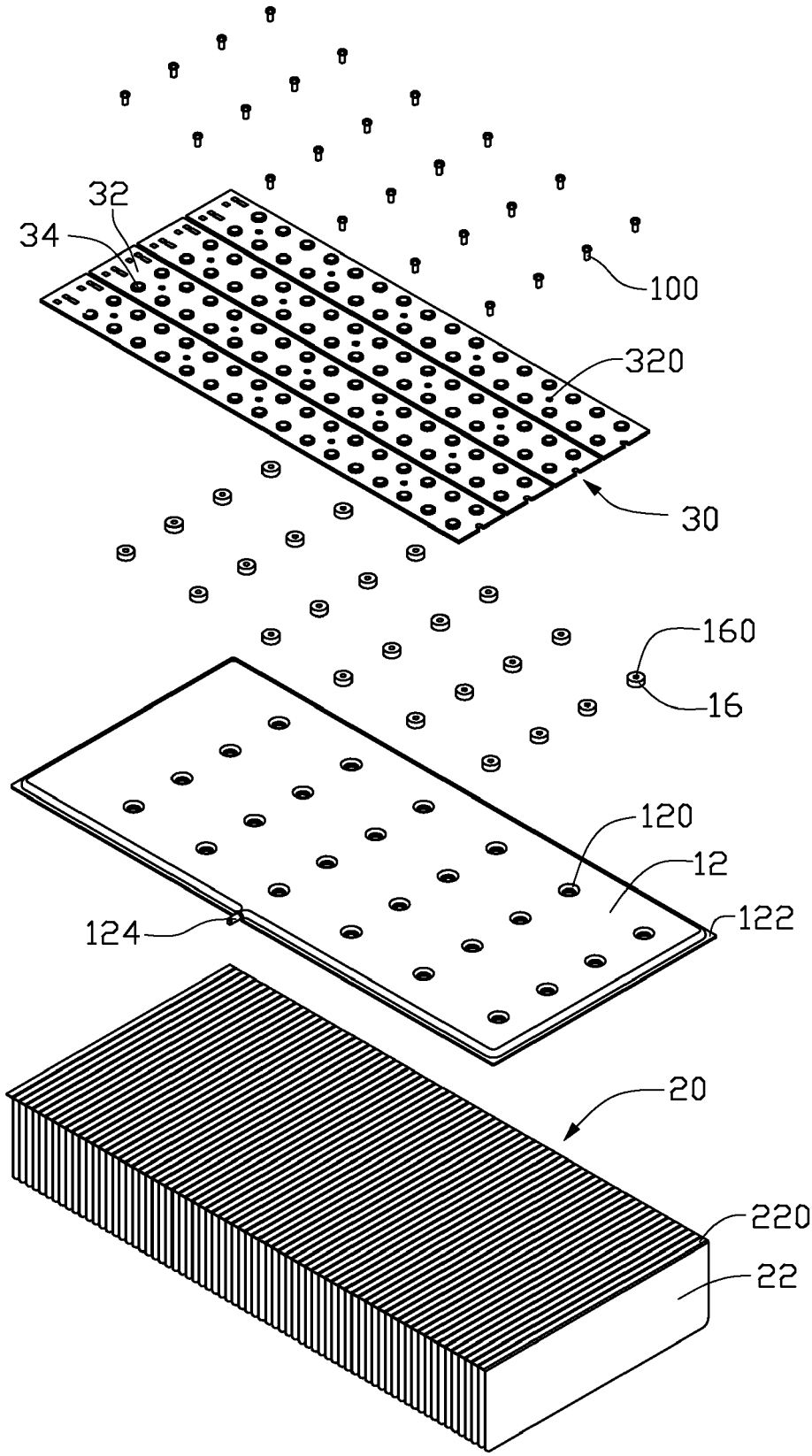
FIG. 3 is a further exploded view of FIG. 2.
Figure 4:
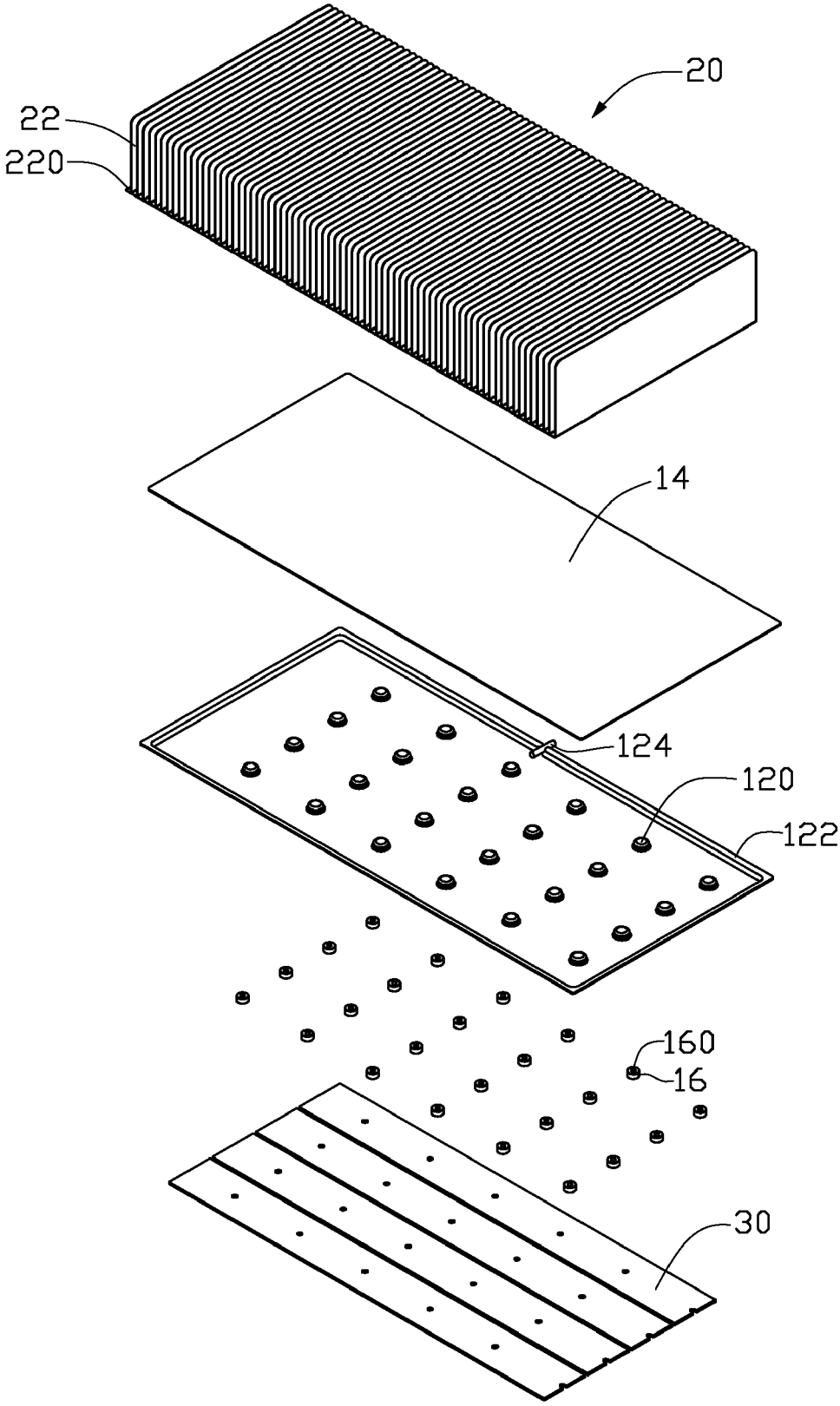
FIG. 4 is an inverted view of the LED lamp in FIG. 3.

Particularly referring to FIGS. 3 and 4, the heat conductive member 10 is a flat-plate type heat pipe (or named as a vapor chamber), functioning as the plate-type heat spreader for quickly absorbing heat produced by the LED modules 30 and transferring the heat produced by the LED modules 30 to the fin unit 20. The heat conductive member 10 comprises a first plate 12, a second plate 14 incorporating with the first plate 12 to form a sealed chamber (not labeled) and a plurality of posts 16 embedded in a top surface of the first plate 12. The first plate 12 is rectangular and defines a plurality of receiving recessions 120 in the top surface thereof. The receiving recessions 120 are formed by punching the first plate 12 and are equidistributed in the top surface of the first plate 12. The recessions 120 are respectively in complementary with the posts 16 and securely receive the posts 16 therein. An engaging flange 122 extends downwardly from a periphery of the first plate 12 and is provided for a hermetical conjunction with a periphery of the second plate 14 by welding. The first plate 12 has a sprue 124 formed in the engaging flange 122, through which the sealed chamber of the heat conductive member 10 is vacuumed and phase-changeable working fluid is injected into the sealed chamber of the heat conductive member 10. The second plate 14 is constructed to fitly engage with the engaging flange 122 of the first plate 12. The second plate 14 has a flat bottom surface. The fin unit 20 has a flat top surface attached to the bottom surface of the second plate 14. The bottom surface of the second plate 14 has an area slightly larger than that of the whole top surface of the fin unit 20, whereby the heat conductive member 10 lays over the whole top surface of the fin unit 20. Each of the posts 16 is interferingly fixed into the corresponding receiving recession 120 or engaged in the corresponding receiving recession 120 by soldering. Each of the posts 16 defines therein a screwed orifice 160 along an axis thereof. Each of the posts 16 has a flat upper surface coplanar with the top surface of the first plate 12 and a lower flat bottom attached to a bottom of a corresponding receiving recession 120 of the first plate 12.

The fin unit 20 is formed from a plurality of fins 22 stacked together. Each of the fins 22 has a flange 220 extending perpendicularly from an upper edge thereof. All of the flanges 220 are arranged in successive to form a flat contacting plane which is attached to the bottom surface of the conductive member 10 by any conventional means such as soldering or adhering.

Each of the LED modules 30 comprises an elongated strip-shaped printed circuit board 32 and a plurality of LEDs 34 mounted on the printed circuit board 32. The printed circuit board 32 defines therein a plurality of fixing orifices 320 which is arranged in a line and in alignment with a corresponding row of the screwed orifices 160 of the posts 16 in the heat conductive member 10. The fixing holes 320 are provided for allowing the screws 100 to extend downwardly therethrough to be engaged into the screwed orifices 160 of the posts 16 in the heat conductive member 10. The LED modules 30 are closely juxtaposed on the top surface of the first plate 12 of the heat conductive member 10.

In assembly of the heat dissipation device, the fin unit 20 is attached to the bottom surface of the heat conductive member 10 by soldering. The LED modules 30 are tightly attached to the top surface of the heat conductive member 10 by extending the screws 100 through the fixing orifices 320 of the LED modules 30 to be threadedly engaged in the screwed orifices 160 of the posts 16 in the top surface of the first plate 12 of the heat conductive member 10.

In use of the heat dissipation device, heat generated from the LED modules 30 is directly adsorbed by the heat conductive member 10 and timely delivered to the fin unit 20 via the heat conductive member 10 to be dissipated into ambient air. The receiving recessions 120 in the first plate 12 of the heat conductive member 10, which receive the posts 16 therein, are not only able to enhance a strength of the heat conductive member 10 for resisting an upward or downward pressure on the first and second plates 12, 14, but also make an attachment of the LED modules 30 onto the conductive member 10 more conveniently and intimately.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat conductive member comprising a first plate, a second plate parallel to the first plate and a plurality of posts embedded in a top surface of the first plate;

a fin unit coupled to a bottom surface of the conductive member; and a plurality of LED modules attached to a top surface of the heat conductive member;

wherein peripheries of the first and second plates are in a hermetical conjunction with each other to form a chamber containing phase-changeable working fluid therein, and the first plate has a plurality of receiving recessions which are depressed downwardly from the top surface thereof and respectively receive the posts therein, screws being extended through the LED modules to threadedly engage in the posts thereby to intimately mount the LED modules to the top surface of the first plate.

2. The LED lamp of claim 1, wherein the first plate is rectangular and has an engaging flange which extends downwardly from a periphery of the first plate and hermetically engages with a periphery of the second plate by welding.

3. The LED lamp of claim 1, wherein the posts are equidistributed in the top surface of the first plate.

4. The LED lamp of claim 1, wherein the fin unit comprises a plurality of fins each of which has a flange extending perpendicularly from a top edge thereof and attached to the bottom surface of the heat conductive member.

5. The LED lamp of claim 1, wherein each of the posts has a flat upper surface coplanar with the top surface of the first plate and a lower flat bottom attached a bottom of a corresponding receiving recession of the first plate.

6. The LED lamp of claim 1, wherein the second plate has a flat bottom surface, and the fin unit has a flat top surface attached to the bottom surface of the second plate, and the bottom surface of the second plate has an area slightly larger than that of a whole top surface of the fin unit, whereby the heat conductive member lays over the whole top surface of the fin unit.

7. An LED lamp comprising:

a heat conductive member having a plurality of posts each of which is embedded in a top surface of the conductive member and defines a screwed orifice therein;

a fin unit coupled to a bottom surface of the heat conductive member; and a plurality of LED modules mounted on a top of the heat conductive member by extending screws downwardly through the LED modules to be engaged into the screwed orifices of the posts in the heat conductive member wherein the heat conductive member comprises a first plate which has the top surface in which the posts are embedded and a second plate parallel to the first plate, and wherein the peripheries of the first and second plate are in a hermetical conjunction with each other to form a chamber containing phase-changeable working fluid therein.

8. The LED lamp of claim 7, wherein a plurality of receiving recessions are depressed downwardly from the top surface of the first plate and engagingly receive the posts therein.

9. The LED lamp of claim 8, wherein the receiving recessions are equidistributed in the first plate.

10. The LED lamp of claim 7, wherein the first plate is rectangular and has an engaging flange which extends downwardly from the periphery of the first plate and hermetically engages with the periphery of the second plate by welding.

11. The LED lamp of claim 7, wherein the fin unit comprises a plurality of fins each of which has a flange extending perpendicularly from a top edge thereof and attached to the bottom surface of the conductive member.

* * * * *